United States Patent [19]

Turko

[11] Patent Number: 4,669,656

[45] Date of Patent: Jun. 2, 1987

[54] HEATING SYSTEM

[75] Inventor: John W. Turko, River Rouge, Mich.

[73] Assignee: Michigan Consolidated Gas Company, Detroit, Mich.

[21] Appl. No.: 770,435

[22] Filed: Aug. 29, 1985

[51] Int. Cl.[4] ..... F24D 5/00

[52] U.S. Cl. ..... 237/53; 237/50; 126/99 R; 126/99 C

[58] Field of Search ..... 237/55, 51, 50, 53; 126/110 R, 99 R, 110 A, 112, 99 A, 99 C

[56] References Cited

U.S. PATENT DOCUMENTS

| | | | |
|---|---|---|---|
| 545,296 | 8/1895 | Kintner | 237/53 |
| 2,060,169 | 11/1936 | Bubar . | |
| 2,543,201 | 2/1951 | Rifley . | |
| 3,209,731 | 10/1965 | Schonberger et al. . | |
| 3,219,027 | 11/1965 | Roche . | |
| 3,760,791 | 9/1973 | Schlies et al. . | |
| 3,815,336 | 6/1974 | Rigo . | |
| 3,844,270 | 10/1974 | Black . | |
| 4,275,705 | 6/1981 | Schaus et al. | 126/116 R X |
| 4,308,990 | 1/1982 | Borovina . | |
| 4,319,557 | 3/1982 | Sietmann . | |
| 4,449,511 | 5/1984 | Hays . | |
| 4,503,902 | 3/1985 | Zolik | 237/55 X |

*Primary Examiner*—Henry A. Bennet

*Attorney, Agent, or Firm*—Harness, Dickey & Pierce

[57] ABSTRACT

An improved heating system is disclosed for providing heated air to a heated space, preferably using a gaseous fuel as the energy source. The system preferably includes an air heating sub-system, a compact combustion chamber, a separate cold air supply sub-system for conveying cold air from the heated space to the air heating sub-system, a combustion chamber heat exchanger in fluid with the cold air supply sub-system for transferring heat thereto, and a separate air circulating sub-system for withdrawing cold circulating air from the heated space. A mixing chamber is provided for mixing heated air from the air heating sub-system with the cold circulating air to provide heated air to the space. The system also preferably includes separate sub-systems for supplying pressurized combustion air and pressurized gaseous fuel to the air heating sub-system and for forcibly conveying exhaust gases therefrom without the need for a draft-type chimney or stack. In another preferred embodiment, a vortex-type air separator separates higher temperature and lower temperature combustion air, with the higher temperature air being used for combustion and the lower temperature air being heated in an exhaust gas heat exchanger before being conveyed to the heated space. A novel control sub-system is also provided for controlling the system, preferably in response to both indoor and outdoor temperatures, and for minimizing the number of energy wasting on/off cycles in operating the system.

37 Claims, 2 Drawing Figures

HEATING SYSTEM

BACKGROUND AND SUMMARY OF THE INVENTION

The invention relates generally to heating systems primarily adapted to providing heated air to a space to be heated, such as a building or on enclosed portion thereof. More specifically, the invention relates to such a heating system fueled by a gaseous fuel.

Previous conventional forced-air heating systems for residential or commercial buildings, or for enclosed portions thereof, have included furnaces that burn a mixture of fuel and air in order to produce heat. Heat exchangers are included for transferring the heat from such combustion to an air flow system that is circulated through the heated space and then returned to the heat exchanger. Such conventional furnace systems have been found, however, to be wasteful in terms of their use of the thermal energy available from the combustion process, largely because exhaust gases are discharged into the atmosphere at considerably high temperatures, frequently in excess of 300 F. (149 C.), which is well in excess of the desired room temperature in the space to be heated.

Even the best of the above-described conventional furnace systems are estimated to waste at least fifteen percent to twenty percent of the gross heating value of the fuel consumed when operating at steady state conditions. Such waste of thermal energy is further compounded by the fact that when the furnace and the circulating fan of such a conventional heating systems are shut off in response to a signal from a thermostat in the heated space, the typical draft-type chimney continues to draw warm air from the furnace and from inside the building and then discharges such warm air to the atmosphere. Then when the thermostat again calls for heat, the system must restart and warm up before being capable of supplying heated air. In the northern states of the United States, this on/off cycling operation is estimated to occur over twenty thousand times per year in a typical forced-air heating system, thus resulting in an overall loss or waste of thermal energy estimated to be approximately forty percent of the available heating value of the fuel consumed.

In addition to the above disadvantages, such conventional heating systems have become economically unfeasible in large residential or commercial structures requiring very high draft-type chimneys. Because of the low cost effectiveness of the construction and maintenance of such large chimneys, such heating systems have frequently been constructed and installed on the roof of such buildings, therefore complicating their installation and increasing their cost. Alternately, especially in multi-tenant or multi-dwelling residential or commercial buildings, electric heating systems have been installed in order to reduce the initial construction cost, allow individual heating control for multiple units of the building, and eliminate the need for the building management to account for, and separately re-bill, the cost of each unit's share of the overall cost of operating a centralized heating system. Such alternate electric heating systems have included electric resistance-type heating units or heat pumps, for example, but suffer the disadvantage of being relatively expensive to operate in comparison with heating systems fueled by gaseous fuels, such as natural gas.

Because of the above-discussed disadvantages and shortcomings of conventional forced-air heating system and of typical electric heating systems, one of the primary objects of the present invention is to provide a forced air heating system, preferably fueled by a gaseous fuel, that effectively uses a much higher percentage of the available heating value of the fuel being consumed and that more effectively recovers a high percentage of the thermal energy present in the exhaust gases discharged to the atmosphere.

Another object of the present invention is to provide such a heating system that does not require a conventional chimney or other draft-type exhaust gas discharge conduit.

Another object of the present invention is to provide a heating system that maximizes the control over the function of the heating system and operates at a lower thermal energy input, but that operates for longer periods of time, thereby minimizing the number of on/off cycles required to maintain a desired temperature in the heated space, thereby maximizing the efficiency of the heating system.

Still another object of the present invention is to provide a heating system that employs a separate system for air circulating at a relatively low velocity to and from the heated space and separate high-velocity air system for transferring the heat of combustion to the air supplied to the heated space, as well as providing separate pressurized combustion air and fuel supply systems that forcibly convey combustion exhaust gases out of the heating system.

In accordance with one aspect of the present invention, a heating system for heating a space generally includes an air heating sub-system with a relatively compact combustion chamber adapted for burning a mixture of combustion air and fuel in order to produce heat, a separate cold air supply sub-system for conveying cold air from the heated space to the air heating sub-system, a combustion chamber heat exchanger in fluid communication with the cold air supply sub-system for transferring heat from the combustion chamber to the cold air withdrawn from the heated space by the cold air supply sub-system, and a separate air circulating sub-system for withdrawing cold circulating air from the heated space. The heating system also preferably includes an air mixing chamber in fluid communication with both the combustion chamber heat exchanger and the air circulating sub-system for mixing heated air with cold circulating air in order to provide heated circulating air to the heated space.

In accordance with another aspect of the present invention, the heating system includes a combustion air supply sub-system having a combustion air compressor for supplying the combustion air to the combustion chamber at an elevated pressure, a gaseous fuel supply sub-system having a gaseous fuel compressor for conveying gaseous fuel from a gaseous fuel source to the combustion chamber at an elevated pressure substantially equal to the elevated pressure of the combustion air, with the pressure of the combustion air and the gaseous fuel being sufficient to forcibly convey the mixture of combustion air and gaseous fuel into the combustion chamber and to forcibly convey the products of combustion through a relatively small exhaust discharge conduit without the need for a draft-type chimney or conduit.

In accordance with still another aspect of the present invention, the combustion air supply sub-system for a heating system includes a separator device, such as a vortex-type separator, that separates combustion air above a predetermined temperature from combustion air that is below such predetermined temperature. Such higher temperature combustion air is conveyed to the combustion chamber of the heating system, and the relatively lower temperature combustion air is conveyed to an exhaust gas heat exchanger for transferring heat from the exhaust gas to such relatively lower temperature combustion air. The combustion air that has been heated in the exhaust gas heat exchanger is then conveyed back to the heated space in order to effectively recover thermal energy that would otherwise have been wasted as the exhaust gas from the combustion chamber is discharged to the atmosphere.

A further aspect of the present invention is the provision of combustion air and gaseous fuel bypass systems, including automatic bypass valves, for bypassing quantities of combustion air and gaseous fuel from the discharges to the intakes of the respective combustion air and gaseous fuel compressors. The bypass systems allow for selective control of the quantities of fuel and air being supplied to the combustion chamber in order to control the heat being supplied to the heated space without the need for the wasteful frequent on/off cycling operation mentioned above in connection with conventional heating systems. In addition, the heating system of the present invention preferably includes a mircoprocessor control system that operates and controls the above bypass systems and other components of the heating system in response to temperature input signals from both the heated space and the exterior surroundings.

Additional objects, advantages and features of the present invention will become apparent from the following description and appended claims, taken in conjunction with the accompanying drawings.

DETAILED DESCRIPTION OF THE PREFERRED EMBODIMENTS

Figures 1, 2:
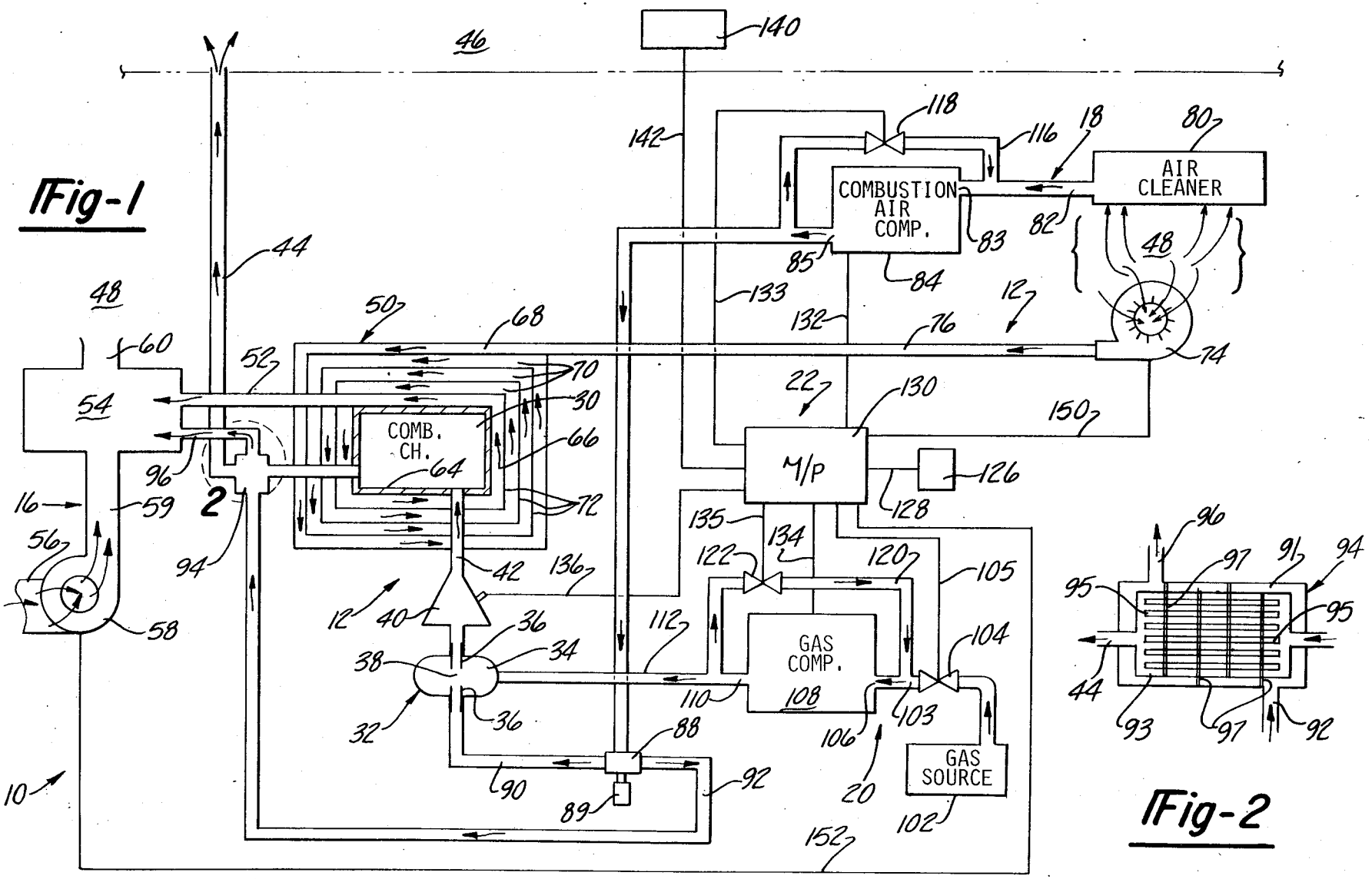
FIG. 1 is a schematic flow diagram of an exemplary heating system according to the present invention.
FIG. 2 is a detailed schematic flow diagram of one preferred exhaust gas heat exchanger of the heating system shown in FIG. 1.

FIGS. 1 and 2 depict in diagrammatic form one preferred exemplary heating system for heating an enclosed space according to the present invention. As will become apparent from the following discussion, however, the principles of the present invention are not limited to the particular space heating application depicted diagrammatically in the drawings, and that the principles of the present invention are equally applicable to heating system arrangements other than that shown in the drawings.

Referring primarily to FIG. 1, an examplary heating system 10 according to the present invention generally includes an air heating sub-system 12, a cold air supply sub-system 14, an air circulating sub-system 16, a combustion air supply sub-system 18, a gaseous fuel supply sub-system 20, and a control sub-system 22.

The air heating sub-system 12 includes a combustion chamber 30 adapted for combustion of a mixture of combustion air and a gaseous fuel respectively supplied to the combustion chamber 30 from the combustion air supply sub-system 18 and the gaseous fuel supply sub-system 20 described below. The combustion air and the gaseous fuel are preferably mixed in adjustable and preselected proportions in an adjustable venturi device 32, which is in fluid communication with the combustion chamber 30 by way of an intake conduit 42. The mixture of gaseous fuel and combustion air is preferably ignited by an electronic ignition device 40, or other known ignition devices, disposed for fluid communication in the intake conduit 42, and injected into the combustion chamber 30. The combustion chamber 30 is preferably relatively small, preferably very close to the size of the flame of the burning fuel and air mixture itself, in order to minimize wasted energy in unnecessarily heating an empty space around the flame.

The adjustable venturi device 32 preferably includes a generally annular gas chamber 34 with a pair of externally-threaded inspirator tubes 36 threadably and adjustably engaged with peripheral portions of the gas chamber 34. The inspirator tubes are spaced apart within the gas chamber 34 to form an opening 38, the size of which is preselectively adjustable by threadably moving the inspirator tubes 36 toward or away from one another. Thus, for a particular application, the proportions of gaseous fuel and combustion air mixed together in the ajustable venturi device 32 can be preselectively adjusted in order to provide a range of fuel-to-air ratios that are consistent with the desired operating conditions in the particular application.

The air heating sub-system 12 also includes a small exhaust conduit 44 in fluid communication with the interior of the combustion chamber 30 for conveying the products of combustion from the combustion chamber 30 to the exterior or ambient surroundings 46 of the heated space 48. A combustion chamber heat exchanger 50 is also associated with the combustion chamber 30 and is adapted to transfer heat produced in the combustion chamber 30 to cold air supplied from the cold air supply sub-system 14 (described below) in order to produce heated air that is in turn conveyed through a heated air discharge conduit 52 to an air mixing chamber 54, which is part of the air circulating sub-system 16 described below.

The air circulating sub-system 16 generally includes a cold air return conduit 56 and a return air fan 58 for withdrawing cold air from the heated space 48 and conveying such cold air to the air mixing chamber 54 by way of a cold air conduit 59. The cold air from the air circulating sub-system 16 is mixed in the air mixing chamber 54 with heated air from the combustion chamber heat exchanger 50 and from an exhaust gas heat exchanger 94 (described below). Such mixing in the air mixing chamber 54 produces a heated air mixture that is conveyed, under the force of the return air fan 58, outwardly from the air mixing chamber 54 to the heated space 48 by way of one or more heated air supply conduits 60.

Cold air is supplied to the combustion air heat exchanger 30 from the heated space 48 by the cold air supply sub-system 14. Such cold air is withdrawn from the heated space by a cold air supply fan 74 and conveyed to the combustion chamber heat exchanger 30 by way of a cold air conduit 76.

In order to effectively transfer a very high percentage of the thermal energy produced in the combustion chamber 30 to the air that is introduced into the air mixing chamber 54, the combustion chamber heat exchanger 50 is preferably of a configuration that substantially fully envelopes the combustion chamber 30. The combustion chamber 30 is enclosed by a combustion chamber enclosure wall 64 composed of a heat-transmissive material having a high thermal conductivity. The enclosure wall 64 is generally surrounded or enveloped by an inner cold air chamber 66, which is in turn surrounded or enveloped by an outer cold air chamber 68, with one or more intermediate cold air chambers 70 disposed therebetween. The inner cold air chamber 66, the outer cold air chamber 68, and the intermediate cold air chambers 70 are separated by het transmissive chamber walls 72 having high thermal conductivity.

The cold air chambers 66, 68, and 70 of the combustion chamber heat exchanger 50 are serially disposed outwardly with respect to one another, with each of the chambers being in fluid communication with its inwardly adjacent chamber such tht cold air from the cold air supply sub-system 14 (described above) flows serially therethrough from the outer cold air chamber 68, through the intermediate cold air chambers 70, and into the inner cold air chamber 66. The heat produced by the combustion process in the combustion chamber 30 is thus transferred through the heat transmissive combustion chamber enclosure wall 64 and serially through the inner cold air chamber 66, through the intermediate cold air chambers 70, and to the outer cold air chamber 68, thus serially heating the air as it serially flows through the combustion chamber heat exchanger 50. The number of cold air chambers surrounding or enveloping the combustion chamber 30 is readily determined by one skilled in the art from the desired cold air inlet and heated air outlet temperatures for a given air flow in a particular application. Optionally, the outer cold air chamber 68 can be covered or surrounded by any of a number of well-known suitable heat insulating materials in order to further minimize thermal energy loss.

The combustion air supply sub-system 18 shown in FIG. 1 preferably includes a combustion air cleaner or filter device 80, which can comprise any of a number of well-known suitable air cleaner or air filter intake devices known to those skilled in the art. Combustion air is withdrawn from the heated space 48 through the combustion air cleaner device 80, and conveyed through an air conduit 82 to the intake or suction side 83 of a combustion air compressor 84. The combustion air compressor 84 raises the pressure of the combustion air to a predetermined pressure level and discharges the compressed combustion air through its discharge side 85 to the air heating sub-system 12 by way of an air conduit 86.

Prior to being introduced into the adjustable venturi device 32, the compressed combustion air preferably passes through a separator device 88. The separator device 88 is preferably a vortex-type separator device, such as those well-known to persons skilled in the art, preferably equipped with a noise-reducing muffler 89. The separator device 88 functions to separate combustion air that is above a predetermined temperature from combustion air that is below such predetermined temperature by separating the relatively heavy, cooler air molecules from the relatively light, higher temperature air molecules. The separated combustion air that is above such predetermined temperature is conveyed through a hot separated air conduit 90 to the adjustable venturi device 32, described above, to be intermixed with gaseous fuel from the gaseous fuel supply sub-system 20 described below.

The separated combustion air that is below the above-discussed predetermined temperature is separated in the separator device 88 and conveyed by way of a cold separated air conduit 92 to an exhaust gas heat exchanger 94 shown generally in FIG. 1, and diagrammatically depicted in more detail in FIG. 2.

As shown in FIG. 2, the exhaust gas heat exchanger 94 preferably includes a plurality of exhaust gas baffles 95 disposed within an inner housing 93. The inner housing 93 is generally surrounded or enveloped by an outer housing 91, which is spaced outwardly apart from the inner housing 93 to allow air from the cold separated air conduit 92 to flow therebetween and to be discharged through an air conduit 96 to the air mixing chamber 54 described above. Preferably, a number of air baffles 97 are disposed in the space between the inner and outer housings 93 and 91, respectively, in order to cause the air flowing therethrough to flow evenly over substantially all of the inner housing 93, thereby effectively transferring heat from the exhaust gas, which may be in the range of approximately 300 F. (149 C.) to approximately 360 F. (182 C.) in many operating conditions, to the air flowing through the exhaust gas heat exchanger 94. By such an arrangement, and by choosing an appropriately-sized exhaust gas heat exchanger 94, as is well within the capabilities of one skilled in the art, a substantial portion of the thermal energy contained in the exhaust gas can be recovered such that the exhaust gas discharged to the exterior ambient surroundings 46 is at a very low temperature, preferably below the temperature desired in the heated space 48, such as at or below 60 F. (16 C.), for example, in many applications. Furthermore, because of the relatively low temperature of the exhaust gas, the exhaust gas conduit 44 can advantageously be constructed of relatively common conduit materials, including common copper tubing, for example, in many applications.

The gaseous fuel supply sub-system 20 as illustrated in FIG. 1, wherein a gaseous fuel is withdrawn from a gas source 102, which can consist of a conventional natural gas supply system or other gaseous fuel sources well-known in the art. The gaseous fuel is conveyed through a safety valve 104, which is preferably adapted to be automatically closed or to automatically fail in a closed condition in the event of a malfunction in the heating system 10. The gaseous fuel is then conveyed through the gas conduit 103 into the intake or suction side 106 of a gaseous fuel compressor 108, which raises the pressure of the incoming gaseous fuel to a predetermined pressure level substantially equal to that of the compressed combustion air described above. The compressed gaseous fuel is then expelled through the discharge side 110 of the gaseous fuel compressor 108 and conveyed by way of a gas conduit 112 to the above-described adjustable venturi device 32, wherein it is intermixed at predetermined proportions with the compressed combustion air before being ignited by the ignition device 40 and injected into the combustion chamber 30.

Because of the elevated pressure of the combustion air and the gaseous fuel, the exhaust gases are also pressurized and thus forcibly conveyed through the exhaust gas conduit 44. Therefore, the exhaust gas conduit 44 does not have to be connected to a draft-type chimney or other conduit and can be relatively small, perhaps as small as a ½ inch (1.3 cm.) or (0.95 cm.) copper tubing, or even smaller, in certain applications.

In order to control the flow rates of the combustion air and gaseous fuel being supplied to the air heating sub-system 12 by the combustion air supply sub-system 18 and the gaseous fuel supply sub-system 20, bypass systems are included in association with the combustion air compressor 84 and the gaseous fuel air compressor 108, respectively. In the combustion air supply sub-system 18, a bypass conduit 116 is connected in fluid communication with the air conduits 86 and 82 in order to allow bypass air flow from the discharge side 85 to the suction or intake side 83 of the combustion air compressor 84. The flow rate of the combustion air flowing through the bypass conduit 116, and thus the discharge flow rate through the air conduit 86, are controlled by modulating an air control valve 118 provided in the bypass conduit 116. Similarly, a bypass conduit 120 is provided in fluid communication with the gaseous conduits 112 and 103 in order to allow gaseous fuel bypass flow from the discharge side 110 to the intake or suction side 106 of the gaseous fuel compressor 108, with the gaseous fuel bypass flow rate being controlled by modulation of a gas control valve 122. Thus, the respective pressures and flow rates of both the combustion air flow and the gaseous fuel flow can be preselectively regulated by modulating the combustion air control valve 118 and the gaseous fuel control valve 122, respectively. Further regulation of these flow rates can optionally be accomplished by regulating the speeds of variable-speed gas and air compressors in addition to, or in lieu of, the bypass systems described above. Regulation of the combustion air supply and the gaseous fuel supply is accomplished by the control sub-system 22 described below.

The control sub-system 22 includes an air temperature sensor 126 located in the heated space 48 and can consist of a conventional thermostat device such as that well-known in the art. The air temperature sensor 126 is operatively connected by way of a suitable conductor 128 with a preferably programmable central microprocessor 130 and is adapted to transmit signals to the central microprocessor 130 in response to varying air temperatures in the heated space 48. The central microprocessor 130 is in turn operatively connected by way of suitable conductors 133 and 135 to the combustion air control valve 118 and the gaseous fuel control valve 122, respectively, in order to transmit appropriate signals for actuating, deactuating, or modulating the respective air and gas bypass systems. The central microprocessor 130 is also in turn operatively connected with the combustion air compressor 84 and the gaseous ful compressor 108 by suitable conductors 132 and 134, respectively, in order to transmit appropriate signals thereto for purposes of actuating, deactuating, or regulating the speed of, the combustion air compressor 84 and the gaseous fuel compressor 108. The central microprocessor 130 is also operatively connected with the electronic ignition device 40 by way of a suitable conductor 136 in order to transmit actuating or deactuating signals thereto for purposes of igniting the mixture of combustion air and gaseous fuel during start-up of the heating system 10, and with the safety valve 104, by way of conductor 105 in order to shut down the system in the event of an emergency or a malfunction.

The control sub-system 22 also includes suitable conductors 150 and 152 for electrically interconnecting the central microprocessor 130 with the cold air supply fan 74 of the cold air supply sub-system 14 and the return air fan 58 of the air circulating sub-system 16. The control sub-system 22 is thus adapted to transmit actuating and deactuating signals, or modulating signals, to both the cold air supply sub-system 14 and the air circulating sub-system 16. By way of this control arrangement, as well as the control arrangement discussed above in connection with the combustion air supply and the gaseous fuel supply, the central microprocessor 130 is adapted to control the heating system 10 in response to sensed air temperatures in the heated space 48 and thereby maintain the air temperature in the heated space 48 at any of a number of preselected temperatures.

Because the ambient temperatures and conditions in the surroundings or exterior 46 of the heated space 48 can have a dramatic effect upon the air temperature in the heated space 48 by way of heat loss or heat gain, it is desirable to also control the operation of the heating system 10 in response to outside temperatures. Therefore, the control sub-system 22 optionally, but preferably, includes an outside air temperature sensor 140 operatively and electrically connected by way of a suitable conductor 142 with the central microprocessor 130. In response to sensed outside temperatures, the outside air temperature sensor 140 can therefore transmit appropriate signals to the central microprocessor 130, which in turn can preferably be programmable to control the heating system 10 in response to signal inputs relating to both the internal air temperature of the heated space 48 and the outside temperature of the exterior surroundings 46. For example, the central microprocessor 130 can preferably be programmed to respond appropriately in a situation where the heated space air temperature sensor 126 calls for heated air but the outside temperature is concurrently increasing, thereby avoiding the duplicative effect of adding heat to the heated space 48 by the heating system 10 while the heated space 48 is also experiencing a heat gain as a result of increasing outside temperatures. Likewise, for example, the central microprocessor 130 can be programmed to respond to decreasing outside temperature in order to cause the heating system 10 to supply additional heated air to the heated space 48 somewhat before the internal air temperature sensor 126 actually calls for more heat. Furthermore, by maintaining close control of the operation of the heating system 10, by way of the above-described control sub-system 22, the heating system 10 can be operated for longer periods of time, but at variable heat output levels, thereby decreasing the number of on/off operating cycles and thus decreasing the opportunity for wasteful heat loss as compared with conventional furnaces and other conventional heating systems.

It should be noted that the central microprocessor 130 can consist of any of a number of conventional, and preferably programmable, microprocessor units well-known to those skilled in the art and adaptable for performing the functions described above. In this regard, it should also be noted that although the control sub-system 22 is schematically depicted in the drawings as an electric control system, one skilled in the art will readily recognize that pneumatic, hydraulic or other control systems for actuating and deactuating the various components described above can readily be substituted for the electric control sub-system 22 depicted for purposes of illustration in the drawings.

The foregoing discussion discloses and describes exemplary embodiments of the present invention. One skilled in the art will readily recognize from such discussion that various changes, modifications and variations may be made therein without departing from the spirit and scope of the invention as defined in the following claims.

What is claimed is:

1. A heating system for heating a space, said heating system comprising:

air heating means including a combustion chamber for burning a mixture of combustion air and fuel in order to produce heat therein, intake means in fluid communication with said combustion chamber for supplying said mixture of combustion air and fuel thereto, and exhaust means in fluid communication with said combustion chamber for discharging products of combustion therefrom;

cold air supply means for conveying cold air from said space to said air heating means;

a combustion chamber heat exchanger in fluid communication with said cold air supply means for transferring heat from said combustion chamber to said cold air from said cold air supply means in order to produce heated air;

air circulating means for withdrawing cold circulating air from said space, said air circulating means being separate from said cold air supply means, said air circulating means including air mixing means in fluid communication with said combustion chamber heat exchanger for mixing said heated air from said combustion chamber heat exchanger with said cold circulating air from said space in order to produce heated circulating air, and means for conveying said heated circulating air from said mixing means to said space;

combustion air supply means for conveying combustion air from said space to said intake means of said air heating means, said combustion air supply means being separate from said cold air supply means and separate from said air circulating means; gaseous fuel supply means for conveying a gaseous fuel from a gaseous fuel source to said intake means of said air heating means;

said combustion air supply means including means having an intake and a discharge for raising the pressure of said combustion air to a predetermined pressure level, and said gaseous fuel supply means including means for raising the pressure of said gaseous fuel to said predetermined pressure level; and combustion air bypass means operatively associated with said combustion air pressure raising means for bypassing a quantity of pressurized combustion air from the discharge to the intake of said combustion air pressure raising means, said combustion air bypass means including a combustion air control valve selectively actuable and deactuable for selectively controlling the quantity of pressurized combustion air being bypassed in order to selectively control the quantity of pressurized combustion air conveyed to said intake means of said air heating means.

2. A heating system for heating a space, said heating system comprising:

air heating means including a combustion chamber for burning a mixture of combustion air and fuel in order to produce heat therein, intake means in fluid communication with said combustion chamber for supplying said mixture of combustion air and fuel thereto, and exhaust means in fluid communication with said combustion chamber for discharging products of combustion therefrom;

cold air supply means for conveying cold air from said space to said air heating means;

a combustion chamber heat exchanger in fluid communication with said cold air supply means for transferring heat from said combustion chamber to said cold air from said cold air supply means in order to produce heated air;

air circulating means for withdrawing cold circulating air from said space, said air circulating means being separate from said cold air supply means, said air circulating means including air mixing means in fluid communication with said combustion chamber heat exchanger for mixing said heated air from said combustion chamber heat exchanger with said cold circulating air from said space in order to produce heated circulating air, and means for conveying said heated circulating air from said mixing means to said space;

combustion air supply means for conveying combustion air from said space to said intake means of said air heating means, said combustion air supply means being separate from said cold air supply means and separate from said air circulating means;

gaseous fuel supply means for conveying a gaseous fuel from a gaseous fuel source to said intake means of said air heating means;

said combustion air supply means including a combustion compressor for raising the pressure of said combustion air to a predetermined pressure level, and said gaseous fuel supply means including a gaseous fuel compressor for raising the pressure of said gaseous fuel to said predetermined pressure level; and combustion air bypass means opratively associated with said combustion air compressor for bypassing a quantity of compressed combustion air from the discharge to the intake of said combustion air pressure compressor, said combustion air bypass means including a combustion air control valve selectively actuable and deactuable for selectively controlling the quantity of compressed combustion air being bypassed in order to selectively control the quantity of compressed combustion air conveyed to said intake means of said air heating means.

3. A heating system according to claim 25, wherein said predetermined pressure level is sufficient to forcibly convey said mixture of combustion air and gaseous fuel into said combustion chamber and to forcibly convey said products of combustion through said exhaust means.

4. A heating system according to claim 2, further including gaseous fuel bypass means operatively associated with said gaseous fuel compressor for bypassing a quantity of compressed gaseous fuel from the discharge to the intake of said gaseous fuel compressor, said gaseous fuel bypass means including a gaseous fuel control valve selectively actuable and deactuable for selectively controlling the quantity of compressed gaseous fuel being bypassed in order to selectively control the quantity of compressed gaseous fuel conveyed to said intake means of said air heating means.

5. A heating system according to claim 4, further including control means including a space temperature sensor for sensing the air temperature in said space, said control means including means for selectively actuating and deactuating said combustion air control valve and said gaseous fuel control valve in response to predetermined air temperatures in said space in order to selectively control the quantity of compressed combustion air and compressed gaseous fuel conveyed to said intake means of said air heating means, said control means thereby maintaining the air temperature in said space generally at a preselected temperature.

6. A heating system according to claim 5, wherein said control means further includes an exterior temperature sensor for sensing the air temperature outside of said space, said control means including means for selectively actuating and deactuating said combustion air control valve and said gaseous fuel control valve in response to predetermined air temperatures outside of said space in order to selectively control the quantities of compressed combustion air and compressed gaseous fuel conveyed to said intake means of said air heating means, said control means thereby also controlling the air temperature in said space generally at a preselected temperature in response to the air temperature outside of said space.

7. A heating system according to claim 1, said combustion air supply means including separator means for separating combustion air that is above a predetermined temperature from combustion air that is below said predetermined temperature, and means for conveying said separated combustion air that is above said predetermined temperature to said intake means of said air heating means.

8. A heating system for heating a space, said heating system comprising:

air heating means including a combustion chamber for burning a mixture of combustion air and fuel in order to produce heat therein, intake means in fluid communication with said combustion chamber for supplying said mixture of combustion air and fuel thereto, and exhaust means in fluid communication with said combustion chamber for discharging products of combustion therefrom;

cold air supply means for conveying cold air from said space to said air heating means;

a combustion chamber heat exchanger in fluid communication with said cold air supply means for transferring heat from said combustion chamber to said cold air from said cold air supply means in order to produce heated air;

air circulating means for withdrawing cold circulating air from said space, said air circulating means being separate from said cold air supply means, said air circulating means including air mixing means in fluid communication with said combustion chamber heat exchanger for mixing said heated air from said combustion chamber heat exchanger with said cold circulating air from said space in order to produce heated circulating air, and means for conveying said heated circulating air from said mixing means to said space; and combustion air supply means for conveying combustion air from said space to said intake means of said air heating means, said combustion air supply means including separator means for separating combustion air that is above a predetermined temperature from combustion air that is below said predetermined temperature, and means for conveying said separated combustion air that is above said predetermined temperature to said intake means of said air heating means, said combustion air supply means being separate from said cold air supply means and separate from said air circulating means.

9. A heating system for heating a space, said heating system comprising:

air heating means including a combustion chamber for burning a mixture of combustion air and fuel in order to produce heat therein, intake means in fluid communication with said combustion chamber for supplying said mixture of combustion air and fuel thereto, and exhaust means in fluid communication with said combustion chamber for discharging products of combustion therefrom;

cold air supply means for conveying cold air from said space to said air heating means;

a combustion chamber heat exchanger in fluid communication with said cold air supply means for transferring heat from said combustion chamber to said cold air from said cold air supply means in order to produce heated air;

air circulating means for withdrawing cold circulating air from said space, said air circulating means being separate from said cold air supply means, said air circulating means including air mixing means in fluid communication with said combustion chamber heat exchanger for mixing said heated air from said combustion chamber heat exchanger with said cold circulating air from said space in order to produce heated circulating air, and means for conveying said heated circulating air from said mixing means to said space; and combustion air supply means for conveying combustion air from said space to said intake means of said air heating means, said combustion air supply means including separator means for separating combustion air that is above a predetermined temperature from combustion air that is below said predetermined temperature, and means for conveying said separated combustion air that is above said predetermined temperature to said intake means of said air heating means, said air heating means further including an exhaust gas heat exchanger for transferring heat from said products of combustion to said separated combustion air that is below said predetemined temperature in order to raise the temperature thereof, and said combustion air supply means including means for conveying said separated combustion air that is below said predetermined temperature from said separator means to said exhaust gas heat exchanger.

10. A heating system according to claim 9, further including means for conveying said heated combustion air from said exhaust gas heat exchanger for said mixing means in order to mix said heated combustion air with said cold circulating air.

11. A heating system according to claim 9, wherein said separator means comprises a vortex separator for separating the relatively heavier molecules of said combustion air that is below said predetermined temperature from the relatively lighter molecules of said combustion air that is above said predetermined temperature.

12. A heating system for heating a space, said heating system comprising:

air heating means including a combustion chamber for burning a mixture of combustion air and fuel in order to produce heat therein, intake means in fluid communication with said combustion chamber for supplying said mixture of combustion air and fuel thereto, and exhaust means in fluid communication with said combustion chamber for discharging products of combustion therefrom;

cold air supply means for conveying cold air from said space to said air heating means;

a combustion chamber heat exchanger in fluid communication with said cold air supply means for transferring heat from said combustion chamber to said cold air from said cold air supply means in order to produce heated air;

air circulating means for withdrawing cold circulating air from said space, said air circulating means being separate from said cold air supply means, said air circulating means including air mixing means in fluid communication with said combustion chamber heat exchanger for mixing said heated air from said combustion chamber heat exchanger with said cold circulating air from said space in order to produce heated circulating air, and means for conveying said heated circulating air from said mixing means to said space; and said combustion chamber heat exchanger including a heat transmissive enclosure wall defining said combustion chamber, said enclosure wall being generally surrounded by an innermost cold air chamber, said innermost cold air chamber being surrounded by a plurality of additional cold air chambers serially disposed outwardly with respect to one another, with inwardly and outwardly adjacent cold air chambers being separated by heat transmissive chamber walls, each of said cold air chambers being in fluid communication with its inwardly adjacent cold air chamber for flow of said cold air serially therethrough from the outermost cold air chamber to said innermost cold air chamber, said heat in said combustion chamber being transferred outwardly from said combustion chamber serially through said heat transmissive enclosure wall and serially through said cold air chambers from said innermost cold air chamber to said outermost cold air chamber in order to transfer said heat to said cold air.

13. A heating system for heating a space, said heating system comprising:

air heating means including a combustion chamber for burning a mixture of combustion air, and a gaseous fuel in order to produce heat therein, a combustion chamber heat exchanger for transferring heat from said combustion chamber to cold air from said space, and exhaust means for discharging products of combustion from said combustion chamber to the atmosphere;

combustion air supply means for conveying combustion air to said air heating means, said combustion air supply means including a combustion air compressor for raising the pressure of said combustion air to a predetermined positive pressure level greater than atmospheric pressure;

gaseous fuel supply means for conveying a gaseous fuel from a gaseous fuel source to said air heating means, said gaseous fuel supply means including a gaseous fuel compressor for raising the pressure of said gaseous fuel to said predetermined positive pressure level greater than atmospheric pressure;

mixing means for mixing said pressurized combustion air and said pressurized gaseous fuel;

ignition means for burning said mixture of pressurized combustion air and pressurized gaseous fuel in said combustion chamber substantially at said predetermined positive pressure level in order to maintain said combustion chamber substantially at said predetermined positive pressure level during operation of said air heating means, said predetermined positive pressure level of said combustion air and said gaseous fuel being sufficient to forcibly convey said mixture of combustion air and gaseous fuel into said combustion chamber and to forcibly convey and exhaust said products of combustion through said exhaust means substantially at said predetermined positive pressure level, said positive pressurization of said products of combustion being the sole means for providing the motivation for discharging said products of combustion to the atmosphere; and combustion air bypass means operatively associated with said combustion air compressor for bypassing a quantity of compressed combustion air from the discharge to the intake of said combustion air compressor, said combustion air bypass means including a combustion air control valve selectively actuable and deactuable for selectively controlling the quantity of compressed combustion air being bypassed in order to selectively control the quanity of compressed combustion air conveyed to said air heating means.

14. A heating system according to claim 13, wherein said exhaust means comprises a length of exhaust tubing in fluid communication with said combustion chamber and with the atmospheric exterior of said space, said predetermined positive pressure level being sufficient to forcibly convey said products of combustion through said exhaust tubing and into said atmospheric exterior of said space without the need for a draft chimney in fluid communication with said tubing.

15. A heating system according to claim 13, further including gaseous fuel bypass means operatively associated with said gaseous fuel compressor for bypassing a quantity of compressed gaseous fuel from the discharge to the intake of said gaseous fuel compressor, said gaseous fuel bypass means including a gaseous fuel control valve selectively actuable and deactuable for selectively controlling the quantity of compressed gaseous fuel being bypassed in order to selectively control the quantity of compressed gaseous fuel conveyed to said air heating means.

16. A heating system according to claim 15, further including control means including a space temperature sensor for sensing the air temperature in said space, said control means including means for selectively actuating and deactuating said combustion air control valve and said gaseous fuel control valve in response to predetermined air temperatures in said space in order to selectively control the quantities of compressed combustion air and compressed gaseous fuel conveyed to said air heating means, said control means thereby maintaining the air temperature in said space generally at a preselected temperature.

17. A heating system according to claim 16, wherein said control means further includes an exterior temperature sensor for sensing the air temperature outside of said space, said control means including means for selectively actuating and deactuating said combustion air control valve and said gaseous fuel control valve in response to predetermined air temperatures outside of said space in order to selectively control the quantities of compressed combustion air and compressed gaseous fuel conveyed to said air heating means, said control means thereby also controlling the air temperature in said space generally at a preselected temperature in response to the air temperature outside of said space.

18. A heating system according to claim 13, further including air circulating means for withdrawing said cold air from said space and for supplying heated air from said air heating means to said space, said air circulating means being separate from said combustion air supply means.

19. A heating system for heating a space, said heating system comprising:

air heating means including a combustion chamber for burning a mixture of combustion air and a gaseous fuel in orde to produce heat therein, a combustion chamber heat exchanger for transferring heat from said combustion chamber to cold air from said space, and exhaust means for discharging products of combustion from said combustion chamber;

combustion air supply means for conveying combustion air to said air heating means, said combustion air supply means including a combustion air compressor for raising the pressure of said combustion air to a predetermined pressure level, said combustion air supply means further including separator means for separating combustion air that is above a predetermined temperature from combustion air that is below said predetermined temperature and means for conveying said separated combustion air that is above said predetermined temperature to said air heating means; and gaseous fuel supply means for conveying a gaseous fuel from a gaseous fuel source to said air heating means, said gaseous fuel supply means including a gaseous fuel compressor for raising the pressure of said gaseous fuel to said predetermined pressure level, said predetermined pressure level of said combustion air and said gaseous fuel being sufficient to forcibly convey said mixture of combustion air and gaseous fuel into said combustion chamber and to forcibly convey said products of combustion through said exhaust means.

20. A heating system according to claim 19, wherein said air heating means further includes an exhaust gas heat exchanger for transferring heat from said products of combustion to said separated combustion air that is below said predetermined temperature in order to raise the temperature thereof, said combustion air supply means including means for conveying said separated combustion air that is below said predetermined temperature from said separator means to said exhaust gas heat exchanger.

21. A heating system according to claim 19, wherein said separator means comprises a vortex separator for separating the relatively heavier molecules of said combustion air that is below said predetermined temperature from the relatively lighter molecules of said combustion air that is above said predetermined temperature.

22. A heating system according to claim 21, wherein said combustion chamber heat exchanger includes a heat transmission enclosure wall defining said combustion chamber, said enclosure wall being generally surrounded by an innermost cold air chamber, said innermost cold air chamber being surrounded by a plurality of additional cold air chambers serially disposed with respect to one another, with inwardly and outwardly adjacent cold air chambers being separated by heat transmissive chamber walls, each of said cold air chambers being in fluid communication with its inwardly adjacent cold air chamber for flow of said cold air serially therethrough from the outermost cold air chamber to said innermost cold air chamber, said heat in said combustion chamber being serially transferred from said combustion chamber through said heat transmissive enclosure wall and serially through said cold air chambers from said innermost cold air chamber to said outermost cold air chamber in order to transfer said heat to said cold air.

23. A heating system for heating a space, said heating system comprising:

air heating means including a combustion chamber for burning a mixture of combustion air and fuel in order to produce heat therein, a combustion chamber heat exchanger for transferring heat from said combustion chamber to cold air from said space, means for conveying said air heated by said combustion chamber heat exchanger to said space, and exhaust means for discharging products of combustion from said combustion chamber;

gaseous fuel supply means for conveying a gaseous fuel from a gaseous fuel source to said air heating means;

a combustion air supply means for conveying combustion air from a source of combustion air to said air heating means, said combustion air supply means including separator means for separating combustion air that is above a predetermined temperature from combustion air that is below said predetermined temperature and means for conveying said separated combustion air that is above said predetermined temperature to said combustion chamber of said air heating means;

an exhaust gas heat exchanger for transferring heat from said products of combustion to said separated combustion air that is below said predetermined temperature in order to raise the temperature thereof, said combustion air supply means including means for conveying said separated combustion air that is below said predetermined temperature from said separator means to said exhaust gas heat exchanger; and means for conveying said combustion air heated by said exhaust gas heat exchanger to said space.

24. A heating system according to claim 23, wherein said separator means comprises a vortex separator for separating the relatively heavier molecules of said combustion air that is below said predetermined temperature from the relatively lighter molecules of said combustion air that is above said predetermined temperature.

25. A heating system according to claim 23, further including cold air supply means for conveying cold air from said space to said combustion chamber heat exchanger, said cold air supply means being separate from said combustion air supply means and including a first fan for forcibly conveying said cold air, and air circulating means for withdrawing cold circulating air from said space, said air circulating means being separate from said cold air supply means and including a second fan for forcibly conveying said cold circulating air, said air circulating means further including air mixing means in fluid communication with said combustion chamber heat exchanger for mixing said heated air from said combustion chamber heat exchanger with said cold circulating air from said space in order to produce heated circulating air and means for conveying said heated circulating air from said mixing means to said space.

26. A heating sytem according to claim 23, further including control means including a space temperature sensor for sensing the air temperature in said space, said control means including means for selectively controlling the quantity of combustion air and the quantity of gaseous fuel conveyed to said air heating means in response to predetermined air temperatures in said space in order to maintain the air temperature in said space generally at a preselected temperature.

27. A heating system according to claim 26, wherein said control means further includes an exterior temperature sensor for sensing the air temperature outside of said space, said control ,means including means for selectively controlling the quantity of combustion air and the quantity of gaseous fuel conveyed to said air heating means in response to predetermined air temperatures outside of said space in order to also maintain the air temperature in said space generally at said preselected temperature in response to the air temperature outside of said space.

28. A heating system for heating a space, said heating system comprising:

air heating means including a combustion chamber for burning a mixture of combustion air and fuel in order to produce heat therein, intake means in fluid communication with said combustion chamber for supplying said mixture of combustion air and gaseous fuel thereto, and exhaust means including a length of exhaust tubing in fluid communication with said combustion chamber and with the exterior of said space for discharging products of combustion from said combustion chamber to said exterior of said space;

cold air supply means including a first fan means for conveying cold air from said space to said air heating means;

a combustion chamber heat exchanger in fluid communication with said cold air supply means for transferring heat from said combustion chamber to said cold air from said cold air supply means in order to produce heated air, said combustion air heat exchanger including a heat transmissive enclosure wall defining said combustion chamber, said enclosure wall being generally surrounded by an innermost cold air chamber, said innermost cold air chamber being surrounded by a plurality of additional cold air chambers serially disposed outwardly with respect to one another, with inwardly and outwardly adjacent cold air chambers being separated by heat transmissive chamber walls, each of said cold air chambers being in fluid communication with its inwardly adjacent cold air chamber for flow of said cold air serially therethrough from the outermost cold air chamber to said innermost cold air chamber, said heat in said combustion chamber being serially transferred from said combustion chamber through said heat transmissive enclosure wall and serially through said cold air chambers from said innermost cold air chamber to said outermost cold air chamber in order to transfer said heat to said cold air;

air circulating means including a second fan means for withdrawing cold circulating air from said space, said air circulating means being separate from said cold air supply means and including air mixing means in fluid communication with said combustion chamber heat exchanger means for mixing said heated air from said combustion chamber heat exchanger with said cold circulating air from said space in order to produce heated circulating air, and means for conveying said heated circulating air from said mixing means to said space;

combustion air supply means for conveying combustion air from said space to said intake means of said air heating means, said combustion air supply means being separate from said air circulating means and separate from said cold air supply means, said combustion air supply means including a combustion air compressor for raising the pressure of said combustion air to a predetermined pressure level, said combustion air supply means further including means for separating said combustion air that is above a predetermined temperature from combustion air that is below said predetermined temperature, and means for conveying said combustion air that is above said predetermined temperature to said intake means of said air heating means;

gaseous fuel supply means for conveying a gaseous fuel from a gaseous fuel source to said intake means of said air heating means, said gaseous fuel supply means including a gaseous fuel compressor for raising the pressure of said gaseous fuel to said predetermined pressure level; and an exhaust gas heat exchanger for transferring heat from said products of combustion to said separated combustion air that is below said predetermined temperature in order to raise the temperature thereof, said combustion air supply means including means for conveying said separated combustion air that is below said predetermined temperature from said separator means to said exhaust gas heat exchanger, and means for conveying said heated combustion air from said exhaust gas heat exchanger to said mixing means in order to mix said heated combustion air with said cold circulating air.

29. A heating system according to claim 28, further including combustion air bypass means operatively associated with said combustion air compressor for bypassing a quantity of compressed combustion air from the discharge to the intake of said combustion air compressor, said combustion air bypass means including a combustion air control valve selectively actuable and deactuable for selectively controlling the quantity of compressed combustion air being bypassed in order to selectively control the quantity of compressed combustion air conveyed to said intake means of said air heating means.

30. A heating system according to claim 29, further including gaseous fuel bypass means operatively associated with said gaseous fuel compressor for bypassing a quantity of compressed gaseous fuel from the discharge to the intake of said gaseous fuel compressor, said gaseous fuel bypass means including a gaseous fuel control valve selectively actuable and deactuable for selectively controlling the quantity of compressed gaseous fuel being bypassed in order to selectively control the quantity of compressed gaseous fuel conveyed to said intake means of said air heating means.

31. A heating system according to claim 30, further including control means including a space temperature sensor for sensing the air temperature in said space, said control means including means for selectively actuating and deactuating said combustion air control valve and said gaseous fuel control valve in response to predetermined air temperatures in said space in order to selectively control the quantities of compressed combustion air and compressed fuel conveyed to said intake means of said air heating means, said control means thereby maintaining the air temperature in said space generally at a preselected temperature.

32. A heating system according to claim 31, wherein said control means further includes an exterior temperature sensor for sensing the air temperature outside of said space, said control means including means for selectively actuating and deactuating said combustion air control valve and said gaseous fuel control valve in response to predetermined air temperatures outside of said space in order to selectively control the quantities of compressed combustion air and compressed gaseous fuel conveyed to said intake means of said air heating means, said control means thereby also controlling the air temperature in said space generally at a preselected temperature in respone to the air temperature outside of said space.

33. A heating system according to claim 28, wherein said separator means compries a vortex separator for separating the relatively heavier molecules of said combustion air that is below said predetermined temperature from the relatively lighter molecules of said combustion air that is above said predetermined temperature.

34. A heating system according to claim 28, wherein said predetermined pressure level of said compressed combustion air and said compressed gaseous fuel is sufficient to forcibly convey said products of combustion through said exhaust tubing and into said exterior of said space without the need for a draft chimney in fluid communication with said tubing.

35. A heating system according to claim 28, wherein said intake means further includes an adjustable venturi means for mixing said compressed combustion air with said compressed gaseous fuel in preselectively adjustable proportions.

36. A heating system according to claim 35, wherein said intake means of said air heating means, further includes ignition means in fluid communication with said adjustable venturi means and with said combustion chamber for igniting said mixture of compressed combustion air and compressed gaseous fuel, and means for conveying said ignited mixture into said combustion chamber.

37. A heating system according to claim 1, wherein said predetermined pressure level is sufficient to forcibly convey said mixture of combustion air and gaseous fuel into said combustion chamber and to forcibly convey said products of combustion through said exhaust means.

* * * * *

UNITED STATES PATENT AND TRADEMARK OFFICE

CERTIFICATE OF CORRECTION

PATENT NO. : 4,669,656

DATED : June 2, 1987

INVENTOR(S) : John W. Turko

It is certified that error appears in the above-identified patent and that said Letters Patent is hereby corrected as shown below:

Column 1, line 8, "on" should be —an--

Column 4, line 25, "ajustable" should be --adjustable--

Column 5, line 10, "het" should be —heat--

Column 5, line 16, "tht" should be —that--

Column 7, line 50, "ful" should be —fuel--

Column 9, line 37, Claim 1, new paragraph beginning with "gaseous fuel..."

Column 10, line 34, Claim 2, "opratively" should be --operatively--

Column 10, line 45, Claim 3, "25" should be —2--

Column 12, line 44, Claim 9, "predetemined" should be --predetermined--

Column 12, line 51, Claim 10, "for" should be —to--

UNITED STATES PATENT AND TRADEMARK OFFICE

CERTIFICATE OF CORRECTION

PATENT NO. : 4,669,656

DATED : June 2, 1987

INVENTOR(S) : John W. Turko

It is certified that error appears in the above-identified patent and that said Letters Patent is hereby corrected as shown below:

Column 15, line 14, Claim 19, "orde" should be —order—

Column 19, line 7, Claim 31, after "compressed" insert —gaseous—

Column 19, line 23, Claim 32, "respone" should be —response—

Column 19, line 26, Claim 33, "compries" should be —comprises—

Signed and Sealed this

Fifteenth Day of March, 1988

*Attest:*

*Attesting Officer*

DONALD J. QUIGG

*Commissioner of Patents and Trademarks*